United States Patent [19]

Bäumer et al.

[11] Patent Number: 4,589,636

[45] Date of Patent: May 20, 1986

[54] GRASPING DEVICE FOR A ROD INSERTABLE INTO AND WITHDRAWABLE FROM THE TAPHOLE OF METALLURGICAL FURNACES, PARTICULARLY TAPPING RODS

[76] Inventors: Albrecht Bäumer, An der Stetze 25, D-5910 Kreuztal-Eichen; Werner Schneider, Biedenkopfer Strasse 16, D-5900 Siegen 1; Hans-Jörg Müller-Späth, In der Kredenbach 5, D-5910 Kreuztal 9; Eberhard Brücher, Lohweg 35, D-5900 Siegen 21, all of Fed. Rep. of Germany

[21] Appl. No.: 666,220

[22] Filed: Oct. 29, 1984

[30] Foreign Application Priority Data

Oct. 28, 1983 [DE] Fed. Rep. of Germany ..... 3339127

[51] Int. Cl.[4] ..... C21C 5/48

[52] U.S. Cl. ..... 266/271; 266/45

[58] Field of Search ..... 266/271, 45, 272, 273; 248/251; 279/102; 294/90, 91

[56] References Cited

U.S. PATENT DOCUMENTS 849,623 4/1907 Killian ..... 294/91
1,782,701 11/1930 Tuck ..... 248/251
4,418,894 12/1983 Mailliet ..... 266/271

FOREIGN PATENT DOCUMENTS 0018347 10/1980 European Pat. Off. ..... 266/45
0122844 10/1984 European Pat. Off. ..... 266/271
1014900 4/1983 U.S.S.R. ..... 266/271

*Primary Examiner*—Melvyn J. Andrews
*Assistant Examiner*—S. Kastler
*Attorney, Agent, or Firm*—Young & Thompson

[57] ABSTRACT

A housing of the grasping device is connected by way of a headpiece with a taphole drilling machine equipped with a counterblow hammer. A clamping mechanism which can be coupled in a force-locking fashion in the housing of the grasping device with the smooth-round end of the tapping rod by means of an operating device is provided, this mechanism being in operative connection with an installation enhancing the clamping force upon an increase in tensile force at the tapping rod. The clamping mechanism can be, for example, a tilting disk surrounding the smooth-round end of the tapping rod with a bore and being in operative connection on one side with a stop fixedly connected to the housing of the grasping device, this stop converting the tensile force at the tapping rod into a tilting moment at the tilting disk so that the clamping force is enhanced.

5 Claims, 11 Drawing Figures

Figure 1:
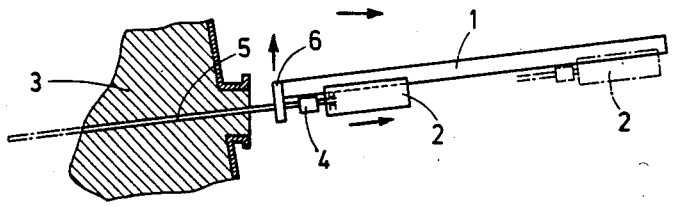

GRASPING DEVICE FOR A ROD INSERTABLE INTO AND WITHDRAWABLE FROM THE TAPHOLE OF METALLURGICAL FURNACES, PARTICULARLY TAPPING RODS

In the technique previously utilized in the drilling of tapholes, the drilling or tapping rod is threadedly connected to a sleeve arranged at the drilling hammer, which is cumbersome. It is also known to screw a sleeve to the drilling or tapping rod and couple the same to the drilling hammber with a bayonet-type insert-turn coupling so that the cumbersome threaded connection in the heat zone is no longer necessary but rather can be performed somewhere remote from the hot area of the furnace and of the pouring spout. In such a case, the drilling or striker rod, in the heat zone, need merely be inserted and turned somewhat, and a safety latch must be provided. Another known possibility for coupling resides in the transverse wedge connection, i.e. a wedge is hammered into a tangential groove of the drilling or tapping rod and secured with a small chain.

More recently, the so-called recoil or counterblow technique has been utilized for tapping a shaft furnace or the like. In this procedure, drilling is abandoned, in principle, and rather a rod is coupled to the hammer, which rod is pounded into the soft stopper compound of the furnace and is then uncoupled. Since then there is no possibility for operating personnel to approach the hot furnace and/or the hot spout, a remote-controlled grasping device must be provided for the rod, which grasping device is opened for uncoupling the rod after the latter has been driven into the stopper compound of the furnace. The carriage is swung into its rest position and remains therein until the next tapping process. At the time of the next tap, the drilling machine, with the carriage, is again pivoted toward the front. At that location, the rod that has been left stuck in the furnace is reconnected and pulled out of the furnace with the counterblow hammer of the drilling machine, so that the taphole is opened in a short span of time.

All of the grasping devices heretofore employed in this process require a shape-mating connection of the rod with the counterblow hammer of the drilling machine, i.e. a correspondingly machined portion must be provided at the beater rod, for example a tangential or peripheral groove, to be able to transmit the forces during pulling out of the rod in a shape-mating fashion. This type of arrangement is provided also for the reason that, in the carriage zone at the machine, only compressed air prevails, for pneumatic drive mechanisms, and a pressure of merely 5 or 6 bar is available at that location so that it is not readily possible to create a grasping device expending such a great power that the tensile force upon pulling out of the rod can be transmitted in a frictional or force-locking fashion. A hydraulic device above the hot pouring spout cannot be utilized on account of the danger of fire in case of a defect.

The invention is based on the object of providing a grasping device capable of grasping smooth rods without any mechanically machined areas and pulling same out of the furnace.

The grasping device of this invention, on account of the automatic reinforcement of the clamping power, has the special advantage that the compressed air of relatively low pressure, provided anyway in the machine, can be utilized for the release or engagement of the grasping device. The drilling or striker rod which, in the above-described tapping process, is being consumed anyway since its end, inserted in the furnace, is being burnt away, does not need any machined zones (grooves, collars, and the like), as heretofore necessary for shape-mating connections.

Figure 6:
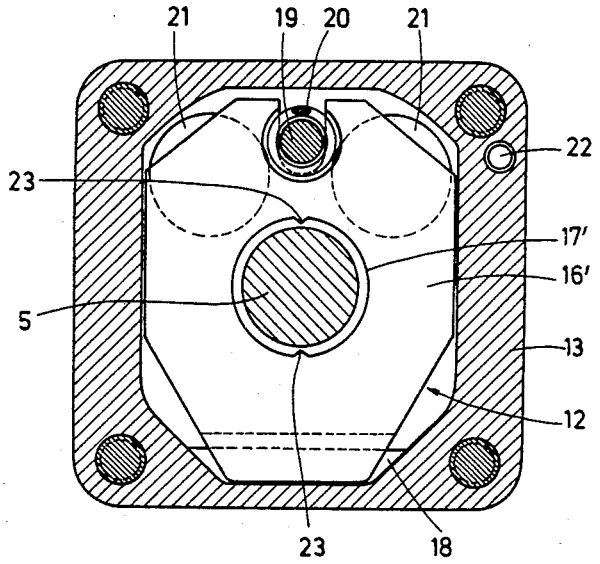
Figure 2:
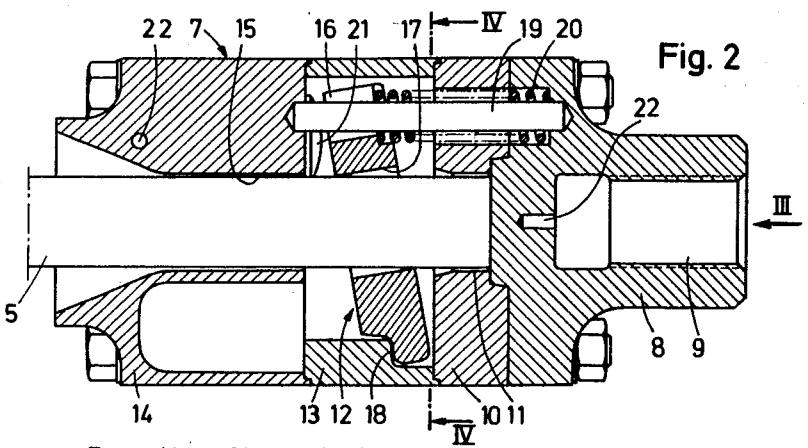
Figure 5:
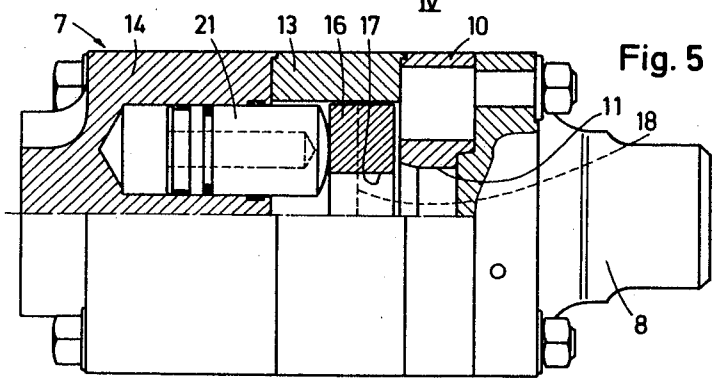
Figure 3:
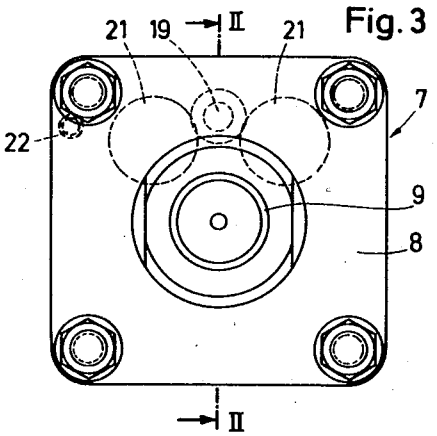
Figure 4:
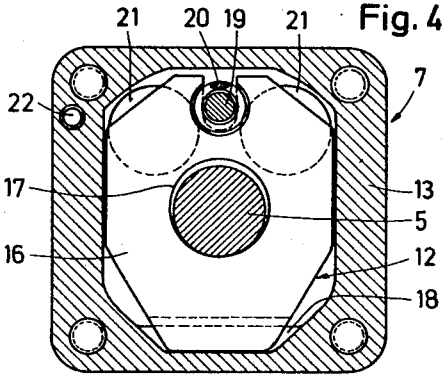
Figure 7:
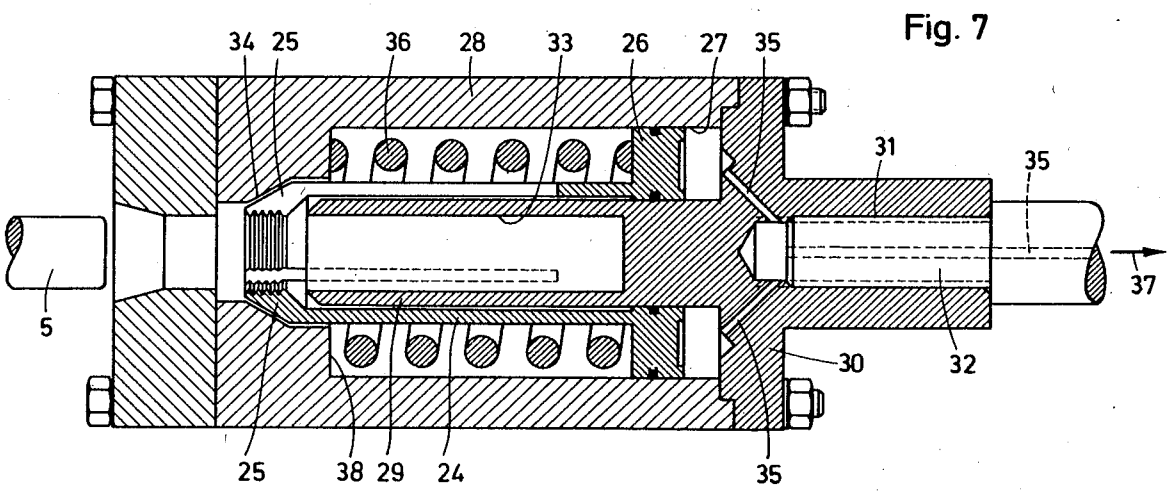
Figure 9:
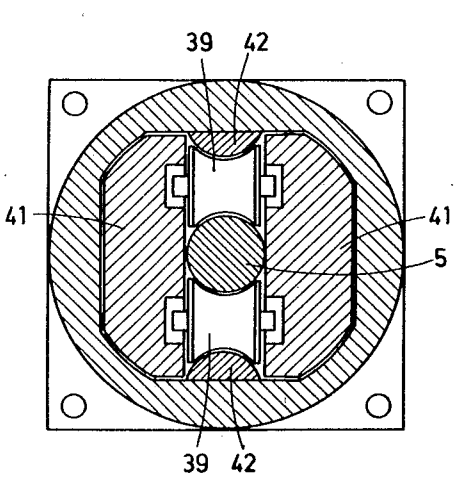
Figure 8:
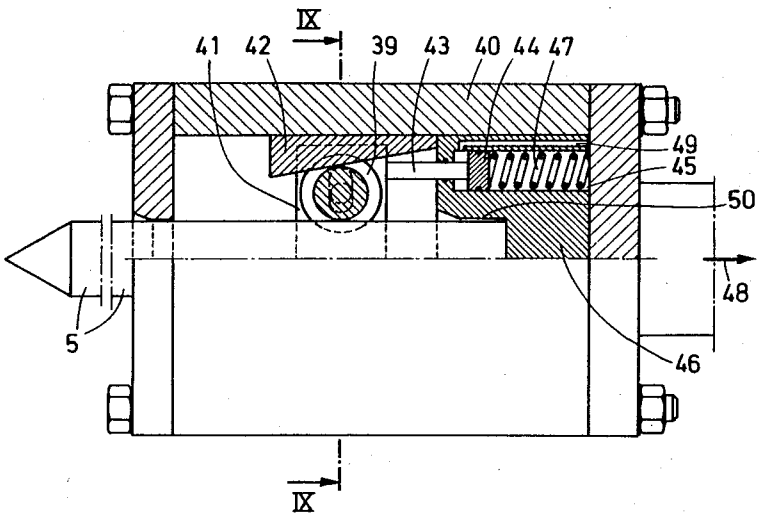
Figure 11:
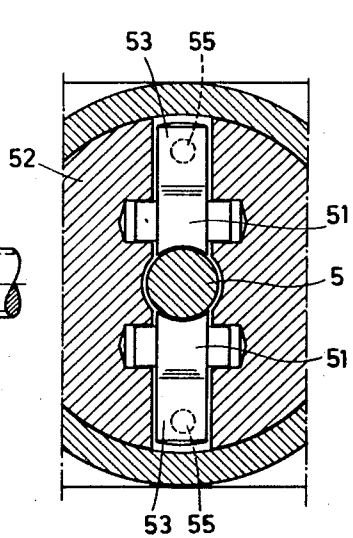
Figure 10:
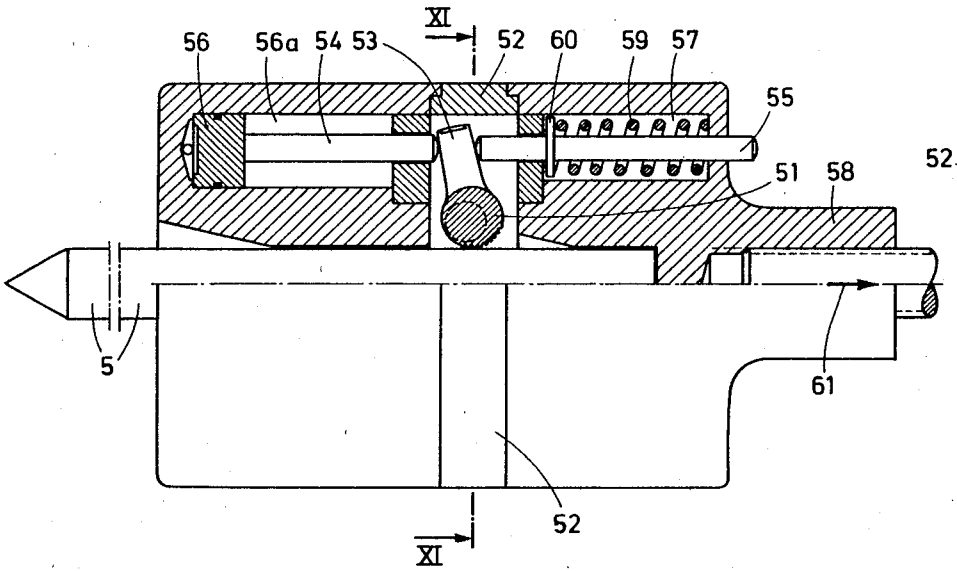

Additional advantages of the invention will become apparent from the following description of embodiments with reference to the drawing wherein:

FIG. 1 is a lateral view of an arrangement wherein the grasping device of this invention is being utilized, FIG. 2 shows, in a longitudinal section along line II—II in FIG. 3, a first, preferred embodiment of the grasping device, FIG. 3 shows a view in the direction of arrow III in FIG. 2, FIG. 4 shows a section along line IV—IV in FIG. 2, FIG. 5 shows a top view, partially broken away, of the embodiment according to FIGS. 2–4, FIG. 6 shows a sectional view, similar to FIG. 4, of a modified embodiment, FIG. 7 shows a second embodiment in a longitudinal sectional view, FIG. 8 shows a lateral view, half thereof in section, of a third embodiment, FIG. 9 shows a section along line IX—IX in FIG. 8, FIG. 10 shows a lateral view, half thereof in section, of a fourth embodiment, and FIG. 11 shows a section along line XI—XI in FIG. 10.

FIG. 1 shows a taphole drilling machine with a drilling carriage 1 which can be conventionally swiveled upwardly and away (see arrows in FIG. 1). A drilling hammer 2, constructed as a counterblow hammer, is displaceably guided on the carriage 1 and exhibits at its end facing a furnace 3 a grasping device 4 to receive a tapping rod 5. Instead of the tapping rod 5, a drilling or beater rod can also be clamped in place, but the following description will refer only to the tapping rod, or rod 5. A guide 6 for the rod 5 is arranged at the end of the carriage 1 facing the furnace. The guide 6 and the grasping device 4 are opened whenever, with the tapping rod 5 having been driven into the taphole of the furnace 3, the entire taphole drilling machine is to be, or must be, swung upwardly and away inorder to remove it as quickly as possible from above the pouring spout (not shown) still filled with hot iron.

The tapping rod 5 remains in the taphole of furnace 3 until the next tapping step. In order to initiate tapping, the taphole drilling machine is first of all returned into the position shown in FIG. 1; the grasping device 4 of the drilling hammer 2 is coupled with the tapping rod 5, as will be described hereinbelow, and the guide 6 at the furnace end of the carriage 1 is closed. With the counterblow of the drilling hammer 2 being activated, the tapping rod 5 is pulled out of the taphole of furnace 3. As soon as the tapping rod 5 has left the taphole, the entire taphole drilling machine is pivoted out of the liquid iron stream, i.e. it is swung upwardly and away (see arrows in FIG. 1).

The embodiment of FIGS. 2–5, preferred for the grasping device 4 of FIG. 1, comprises a housing 7 consisting of a coupling member 8 with a threaded bore 9 which can be threadedly connected with the drilling hammer 2, a spacer ring 10 with a bore 11 receiving the tapping rod 5, an intermediate housing 13 accommodating the clamping mechanism 12, and a mounting element 14 with a bore 15 that flares like a funnel toward the outside for accommodating the smooth-cylindrical insert end of the tapping rod 5.

The clamping mechanism 12 exhibits a tilting disk 16 surrounding the tapping rod 5 with a bore 17, the diameter of the latter being larger than the diameter of the tapping rod 5. Underneath the tapping rod 5, the tilting disk 16 rests against an abutment 18 in the intermediate housing 13, and above the tapping rod 5, a compression spring 20, guided on a guide pin 19, is provided which tends to urge the tilting disk 16 into the tilted position shown in FIG. 2 so that the bore 17, according to the illustration in FIG. 2, engages with its forward (left-hand) edge at the top and with its rearward (right-hand) edge at the bottom of the tapping rod 5. If, now, the tapping rod 5 with the drilling hammer 2 (FIG. 1) is pulled out of the taphole of furnace 3, then the stop 18 presses against the tilting disk 16 of the clamping mechanism 12. The stronger the tensile force of the drilling hammer 2 at the housing 7 of the grasping device 4, the stronger becomes the clamping action of the tilting disk 16 at the tapping rod 5.

In order to release the clamping mechanism 12 and thus to take out or insert the tapping rod 5, two pistons 21 operated by compressed air are provided on the side of the tilting disk 16 facing away from the compression spring 20. When pressure is exerted on the pistons 21, they tilt the tilting disk 16 into a straight position approximately perpendicularly to the axis of the tapping rod 5, as shown in FIG. 5, so that the tapping rid 5 is freed. The compressed air is supplied to the pistons 21 via ducts 22.

In FIG. 6, wherein the same reference numerals as in FIGS. 2–5 are used for identical parts, a modification of the tilting disk 16′ is illustrated. In this arrangement, the bore 17′ exhibits, along the edges engaging the tapping rod 5 in the oblique position (FIG. 2), teeth or points 23 cutting into the tapping rod 5 so that, if desired, the drilling hammer 2 can also be used for transmitting a torque to the tapping rod 5.

In the embodiment of FIG. 7, the clamping mechanism has a repeatedly slotted clamping sleeve 24 with serrated gripping jaws 25 fashioned conically on the outside. The clamping sleeve 24 is fixedly joined to an annular piston 26 tightly guided on the outside in a bore 27 of a housing part 28 and on the inside on a pin 29 of a coupling member 30. The coupling member 30 exhibits on the outside a threaded bore 31 to be threaded onto a threaded pin 32 of the drilling hammer 2 and, within the pin 29, a smooth bore 33 to receive the tapping rod 5.

The gripping jaws 25, having a conical shape on the outside, cooperate with an internal conical surface 34 of the housing part 28 when the annular piston 26 is under the action of compressed air via compressed air ducts 35 and urges the clamping sleeve 29, against the force of a compression spring 36, with its gripping jaws 25 against the inner conical surface 34 of housing part 28 so that the inserted tapping rod 5 is seized by the gripping jaws 25. If, now, the drilling hammer 2, with the return or counter stroke being activated, is retracted in the direction of arrow 37 with the grasping device and the tapping rod 5, then the clamping force of the gripping jaws 25 is increased by the wedge effect of the internal conical surface 34 of housing part 28. Once the compressed air is no longer supplied, the annular piston 26 is urged backwards (toward the right in FIG. 7) with the clamping sleeve 29, on account of the compression spring 36 which is supported at its end facing away from the annular piston 26 on a shoulder 38 of the bore 27 of housing part 28. Accordingly, the gripping jaws 25 of the clamping sleeve 29 release the tapping rod 5. In this embodiment, in contrast to the embodiment of FIGS. 2–6, the compressed air is utilized to initiate the clamping process, and the compression spring 36 is used to release the clamping mechanism.

Another possible embodiment is shown in FIGS. 8 and 9. In this embodiment, clamping rollers 39 are utilized which are supported, in a bipartite cage component 41 movably guided in a housing part 40, to be rotatable about axes transversely to the tapping rod 5 and to be displaceable within limits radially to the tapping rod 5. The rolling face of each clamping roller 39 is of a concave curvature in correspondence with the radius of the tapping rod 5 and, for producing a wedging action when the tapping rod 5 is pulled out of furnace 3, is in operative connection with respectively one wedge 42, the wedge face of which is of a convex curvature in correspondence with the radius of the tapping rod 5 and the clamping rollers 39. The wedges 42 thus have the geometrical configuration of an oblique cylindrical section.

In the illustrated embodiment, two clamping rollers 39 in mutual diametrical opposition are provided, but it is also possible to arrange four clamping rollers 39 in crosswise pattern with four wedges 42 associated therewith. The wedges 42 are attached in the housing part 40. Piston rods 43 are connected to the cage component 41, these piston rods pertaining to, for example, four pistons 44 guided in cylindrical bores 45 of a housing insert 46 and being under the influence of compression springs 47 tending to move the cage component 41 with the clamping rollers 39 into the clamping position (toward the left in FIG. 8). If now a pulling action is exerted in the direction of arrow 48, the clamping effect of the clamping rollers 39 is enhanced by the wedges 42. In order to release the clamping mechanism, the pistons 44 are placed under compressed air via ducts 49 so that, via the piston rods 43, the cage component 41 with the clamping rollers 39 is retracted (toward the right in FIG. 8) and the tapping rod 5 can be freely pulled out or a new one can be introduced. The tapping rod 5, while being driven into the furnace 3 (FIG. 1) finds its abutment in a blind bore 50 of the housing insert 46.

In another possible embodiment, illustrated in FIGS. 10 and 11, eccentrics 51 (two or four) are utilized as the clamping mechanism. These eccentrics 51 are rotatably mounted in a bipartite intermediate housing member 52 about axes extending transversely to the axis of the tapping rod 5 and exhibit, similarly to the clamping rollers 39 of FIGS. 8 and 9, a surface with a concave curvature in correspondence with the radius of the tapping rod 5. Respectively one lever arm 53 is fixedly joined to each eccentric 51 and is disposed, with its free end, respectively between two plungers 54, 55, of which one plunger 54 forms the piston rod for a piston 56 and the other plunger 55, in a corresponding bore 57 of a coupling member 58 of the grasping device, is under the effect of a compression spring 59 supported against an annular disk 60 attached to the plunger 55. The compression springs 59 tend to detach the eccentrics 51 from the tapping rod 5 when the pistons 56 are not under the action of compressed air. In order to tension the clamping mechanism, the pistons 56 are placed under compressed air so that the eccentrics 51, by way of the plungers 54 (piston rods) and the lever arms 53, come into contact with the tapping rod 5. With a pulling action exerted in the direction of arrow 61, the eccentrics 51, via the lever arms 53, are ever more tightly urged against the tapping rod 5 so that here, too, an action enhancing the clamping power is being exerted. If the eccentrics 51 should have been clamped too firmly against the tapping rod 5, there is the possibility of releasing the eccentrics 51 by a slight tap against the ends of the plugers 55 projecting out of the coupling member 58.

According to the illustration in FIG. 10, the piston 56 can also be an annular piston, as in FIG. 7, in place of providing several, for example four, pistons 56 seated in individual cylinder bores; this annular piston is displaceably arranged in an annular recess **56*a* of the housing. In this case, the plungers 54** can be freely guided and need not be piston rods firmly joined with the annular piston.

In the grasping devices described hereinabove, the parts 39, 51 engaging the tapping rod 5 can be provided with teeth or tines—as in the embodiments of FIGS. 6 and 7—in order to be able to transmit to the tapping rod 5 a torque as well, by activating the rotary drive of the drilling hammer 2, if this is desired or necessary.

In several of the aforedescribed embodiments, compressed air is utilized to initiate the clamping action while the release of the clamping mechanism is effected by the compression springs (FIGS. 7 and 10, 11). In the other embodiments, compressed air is utilized for releasing the clamping mechanism whereas the compression springs, with the pistons being without pressure, take care of initiating the clamping effect (FIGS. 2–6, 8, and 9). In all cases, the reverse arrangement is likewise possible.

We claim:

1. In a taphole drilling machine having a counterblow hammer having a grasping device adapted to receive and releasably retain a tapping rod for the taphole of a metallurgical furnace; the improvement in which the grasping device comprises a housing, and within this housing a tilting member, a stop within the housing against which one end of the tilting member rockably bears, the tilting member having therein a recess of a size larger than a said tapping rod to receive therein a said tapping rod, means engageable with the tilting member on the side of the tilting member opposite said stop to urge said tilting member to a tilted position in which the tapping rod is grasped by the margins of said recess, and means for selectively acting against the tilting member in a direction opposite to the direction in which said urging means urges the tilting member to tilt, thereby to swing the tilting member back about the stop to a position in which a said tapping rod can be freely inserted into or withdrawn from said recess.

2. Apparatus as claimed in claim 1, in which said oppositely-acting means comprises at least one fluid pressure cylinder and piston assembly a portion of which acts against said tilting member.

3. Apparatus as claimed in claim 2, there being two of said fluid pressure cylinder and piston assemblies disposed one on either side of said urging means.

4. Apparatus as claimed in claim 1, said urging means comprising a coil compression spring acting between said housing and said tilting member.

5. Apparatus as claimed in claim 4, and a guide pin secured at opposite ends in said housing, said coil compression spring surrounding said guide pin, said guide pin passing through a recess in said tilting member.

* * * * *